United States Patent [19]

Schwob

[11] 4,240,217

[45] Dec. 23, 1980

[54] ELECTRIC STEAM IRON

[75] Inventor: Pierre Schwob, Lyons, France

[73] Assignee: SEB S.A., Selongey, France

[21] Appl. No.: 968,299

[22] Filed: Dec. 11, 1978

[30] Foreign Application Priority Data

Dec. 21, 1977 [FR] France ..... 77 38644

[51] Int. Cl.[3] ..... D06F 75/18

[52] U.S. Cl. ..... 38/77.83

[58] Field of Search ..... 38/77.5, 77.6, 77.7, 38/77.8, 77.81, 77.82, 77.83, 77.9, 93

[56] References Cited

U.S. PATENT DOCUMENTS

| | | | |
|---|---|---|---|
| 2,353,604 | 7/1944 | Waring et al. | 38/77.9 |
| 2,425,598 | 8/1947 | Clum | 38/77.83 |
| 2,483,579 | 10/1949 | Green | 38/77.83 |
| 2,515,100 | 7/1950 | Sutton | 38/77.6 |
| 2,683,320 | 7/1954 | Morton | 38/77 |
| 2,750,690 | 6/1956 | Gomersall | 38/77 |
| 2,774,156 | 12/1956 | Parr | 38/77.83 |
| 2,815,592 | 12/1957 | Gomersall | 38/77.83 |
| 2,817,912 | 12/1957 | Schott et al. | 38/77.83 |
| 3,045,371 | 7/1962 | Kurlinski | 38/77.9 |
| 3,335,507 | 8/1967 | Uieceli | 38/77.9 |

FOREIGN PATENT DOCUMENTS

| | | |
|---|---|---|
| 1065595 | 5/1954 | France . |
| 2212457 | 7/1974 | France . |
| 811363 | 4/1959 | United Kingdom . |

*Primary Examiner*—Louis Rimrodt

*Attorney, Agent, or Firm*—Young & Thompson

[57] ABSTRACT

The steam iron comprises a water reservoir fitted with a device for injecting water into a vaporization chamber which occupies substantially the entire space formed between the two arms of a U-shaped electric heating resistor and extends to the level of the rear edge of the sole-plate. The vaporization chamber communicates with a distribution chamber by means of recesses formed in the top edge of a partition-wall in the rear portion of the iron. Vaporization takes place on all the chamber walls and the maximum flow path is provided for the vapor, thereby minimizing scale formation.

10 Claims, 16 Drawing Figures

FIG_14
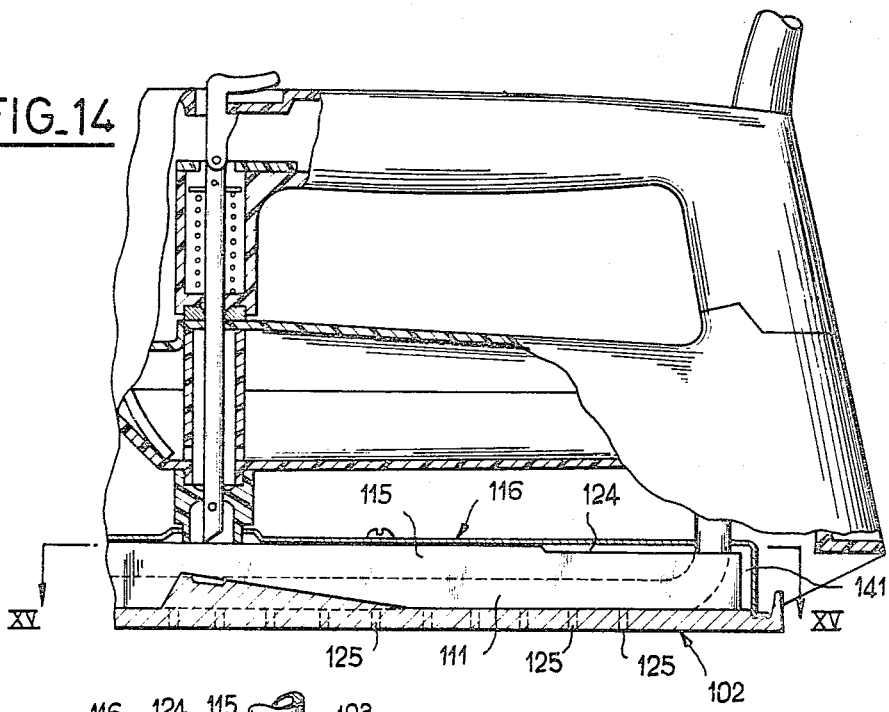
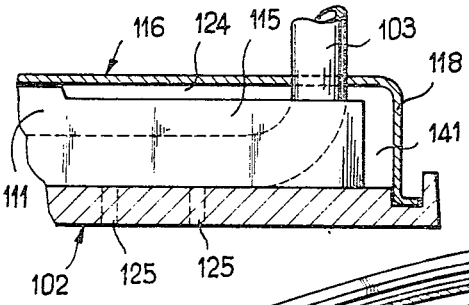
FIG_16
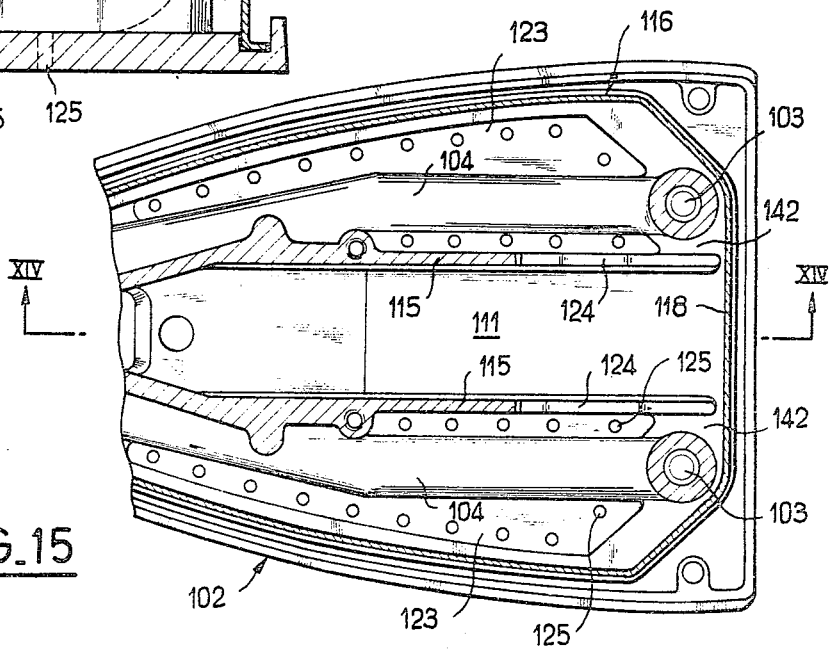
FIG_15

ELECTRIC STEAM IRON

This invention relates to an electric steam iron of the type comprising a water reservoir provided with a device for injecting water into a vaporization chamber.

In known appliances of this type, the vaporization chamber constitutes a single-unit assembly with the sole-plate and has relatively small dimensions in order to be located in the vicinity of the hottest point of the iron. In the most common case in which the heating resistor is arranged in a U, the hottest point is located at the base of the U.

These small dimensions of the chamber have a disadvantage in that they have the effect of concentrating the vaporization on a small area of metal. This gives rise to rapid scale formation in the chamber unless demineralized water is employed.

The above-mentioned arrangement has a further disadvantage in that it calls for the presence of pipes in order to convey the steam produced to the discharge holes, the discharge outlets of which are spaced at intervals in the underface of the sole-plate. Apart from the fact that they are relatively difficult to manufacture in a foundry, pipes of this type must be arranged in such a manner as to prevent any evaporation of residual liquid which would be liable to cause scale formation in said pipes. In addition, they must be so arranged as to prevent any cooling of the steam since this would have the effect of discharging water onto the linen which is being ironed.

Another factor to be taken into account in the arrangement of the steam pipes is the awkward problem which arises from the need to ensure substantially equal distribution of the steam between the various discharge holes.

Attempts have been made to overcome these drawbacks by making provision for mechanical de-scaling means. Even assuming that this operation is just feasible in the case of the vaporization chamber which can be made accessible, it still remains a tedious procedure if it has to be repeated too often. Furthermore, it is very difficult in practice to ensure efficient removal of scale from the interior of the pipes.

The primary objective of the present invention is to provide a steam iron which gives rise only to slow and very slight scale formation. A secondary aim of the invention is to provide an improved version of steam iron of the above-mentioned type which also permits of easy and practically total scale removal.

In accordance with the invention, the electric steam iron comprises a water reservoir fitted with a device for injecting water into a vaporization chamber formed in a sole-plate which is heated by a U-shaped electric resistor, the arms of the U being disposed along the two sides of the iron which have the greatest length and the point of injection being located in the vicinity of the base of the U. Said vaporization chamber occupies at least part of the space located between the resistor arms and communicates with a distribution chamber through a partition-wall. Said distribution chamber communicates with the exterior through discharge holes having outlets on the underface of the sole-plate. A characteristic feature of the steam iron lies in the fact that the vaporization chamber occupies substantially the entire space formed between the arms of the resistor and extends to the level of the rear edge of the sole-plate. A communication between the two chambers is established by means of recesses formed in the partition-wall and located in the rear portion of the iron.

A chamber of substantial size is thus provided and the steam or the water undergoing vaporization is intended to pass along the full length of the chamber since the point of injection of water is located in the vicinity of the base of the U and therefore in the front portion of the iron whilst the steam outlet recesses are located in the rear portion. Since vaporization takes place on all the walls of the chamber, the rate of scale formation per unit area is very low, with the result that the thickness of scale increases at a very low rate; this thickness accordingly constitutes a practically negligible drawback throughout the service life of the iron.

Preferably, the recesses are located in the rear third of the iron and, in an improved embodiment of the invention, extend to the rear end of the partition-wall in order to provide the maximum flow path for the vapor which is being formed.

In an advantageous embodiment of the invention, the walls of the chambers located opposite to the sole-plate are provided with a cover which is applied against the crest of the partition-wall, thus constituting a simple and economical mode of manufacture.

In a preferred embodiment of the invention, the recesses are oblong and have a dimension parallel to the sole-plate which is longer than the dimension at right angles to the sole-plate, said recesses being located in the vicinity of the cover which cooperates with the partition-wall.

By giving the recess an elongated shape and by placing the recess at a distance from the bottom of the vaporization chamber, a significant part is thus played in preventing the non-vaporized residual water from escaping with the steam through the recess.

In a first alternative embodiment of the invention, the distribution chamber is limited externally by a partition-wall against which the cover is intended to be applied.

The two chambers are thus constituted by very simple means which can readily be disassembled.

In a second alternative embodiment of the invention, the distribution chamber is limited externally by a peripheral skirt of the cover.

The construction of the cover is a little less straightforward but the fabrication of the sole-plate is facilitated by the suppression of one of the partition-walls.

In an improved embodiment of the invention, a passage is formed between the rear end of the partition-wall and the rear portion of skirt of the cover.

In the first place, said passage has the effect of displacing the steam outlet even farther to the rear, with the result that the flow path mentioned above is made even longer. Furthermore, since the passage extends vertically from the foot of the partition-wall to the crest, it permits evacuation of the water which would otherwise be liable to flood the vaporization chamber as a result of a faulty operation. This water thus passes into the distribution chamber and is discharged from the iron through the holes of the sole-plate.

In accordance with another important improvement of the invention, the vaporization chamber has a substantially constant cross-section in planes at right angles to the normal direction of the iron and terminates at the rear end of the iron in a pluggable orifice which has substantially the same cross-sectional area.

Since the orifice aforesaid has relatively large dimensions, this offers the advantage of easy access to the interior of the vaporization chamber for the purpose of mechanical scale removal. This de-scaling operation can be perfected even further by rinsing the chamber with or without a de-scaling product.

Preferably, the orifice aforesaid is closed by means of a plug of plastic material which is maintained in position and provides a hermetic seal by virtue of the elasticity of the material.

Finally, the vaporization chamber can advantageously comprise a boss which serves to join together the two arms of the U-shaped resistor, said boss being located directly beneath the water injection device.

The above-mentioned boss performs the double function of a thermal bridge between the resistor and the point of downward discharge of the water, and of means for heat storage at the point corresponding to preferential vaporization, with the result that the thermal inertia which is thus obtained ensures uniform vaporization.

Further distinctive features and advantages of the invention will become apparent from the following detailed description, reference being made to the accompanying drawings which are given by way of example without any limitation being implied, and in which:

FIG. 14 is a longitudinal part-sectional view of another embodiment of the invention, this view being taken along line XIV—XIV of FIG. 15;

FIG. 15 is a horizontal part-sectional view taken along line XV—XV of FIG. 14;

FIG. 16 is a view to a larger scale showing a portion of FIG. 14.

Figure 1:
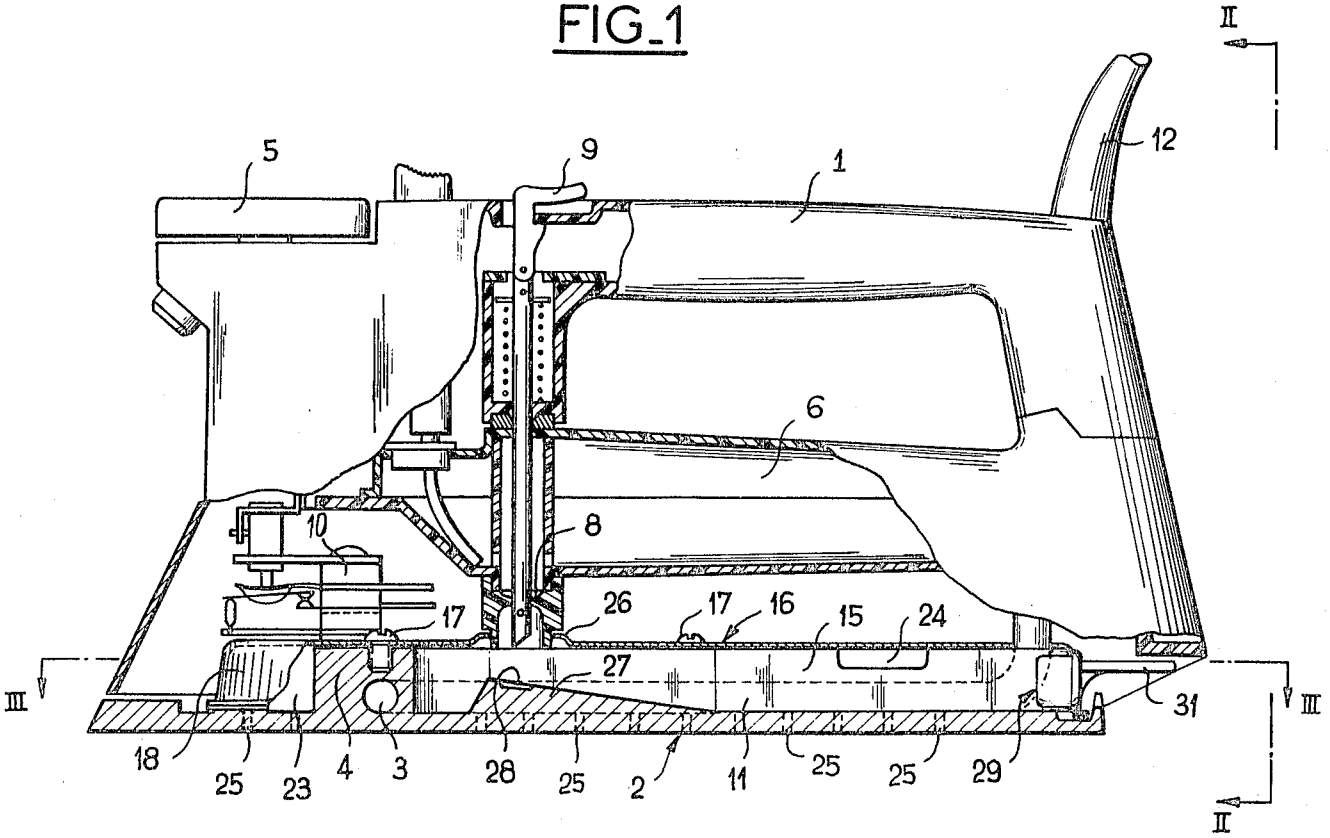
FIG. 1 is a general longitudinal view of a steam iron in accordance with the invention, said iron being shown partly in section with portions broken away.
Figure 2:
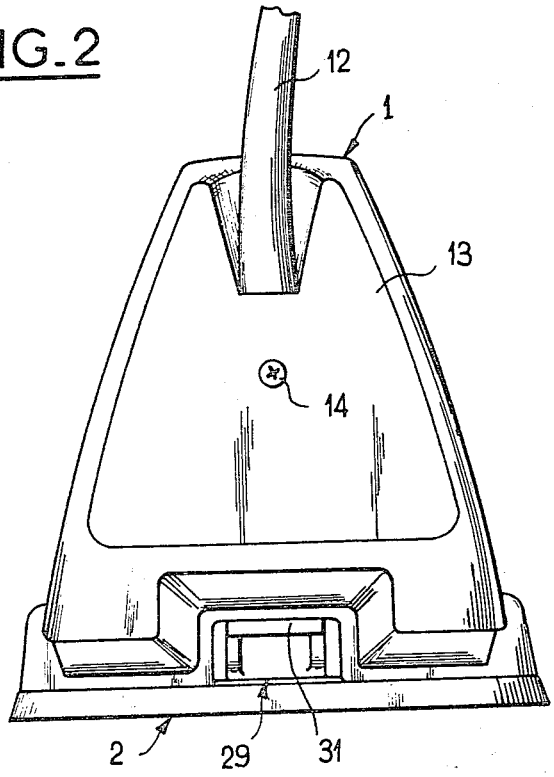
FIG. 2 is a rear view of the iron, this view being taken along line II—II of FIG. 1.

Referring first to FIGS. 1 and 2, the iron in accordance with the invention comprises a handle 1 attached by known means (not shown) to a sole-plate 2 in which is incorporated a U-shaped metal-clad resistor 3 placed within an embossment 4 (FIG. 3) in a direction parallel to the plane of the sole-plate 2.

The iron is provided with a thermostat 10 which is adjustable by means of an external control knob 5 and with a water reservoir 6 which can be filled by means of a circulation system (not shown in the drawings). Said reservoir is equipped with an injection device 8 of the type comprising a pintle which can be operated by means of a lever 9 so as to permit discharge of water into a vaporization chamber 11 which will be described hereinafter.

Electric current is supplied to the heating resistor by means of a cable 12 connected to a terminal plate (not shown), access being gained to said terminal plate by removing a rear plate 13 which is held in position by means of a screw 14.

The point of injection of water is located in the vicinity of the base of the U formed by the heating resistor, that is to say in the front half of the steam iron (in the normal direction of displacement of this latter).

The sole-plate 2 and accessory elements of this latter will now be described in greater detail with reference to FIGS. 1 to 4.

Figure 3:
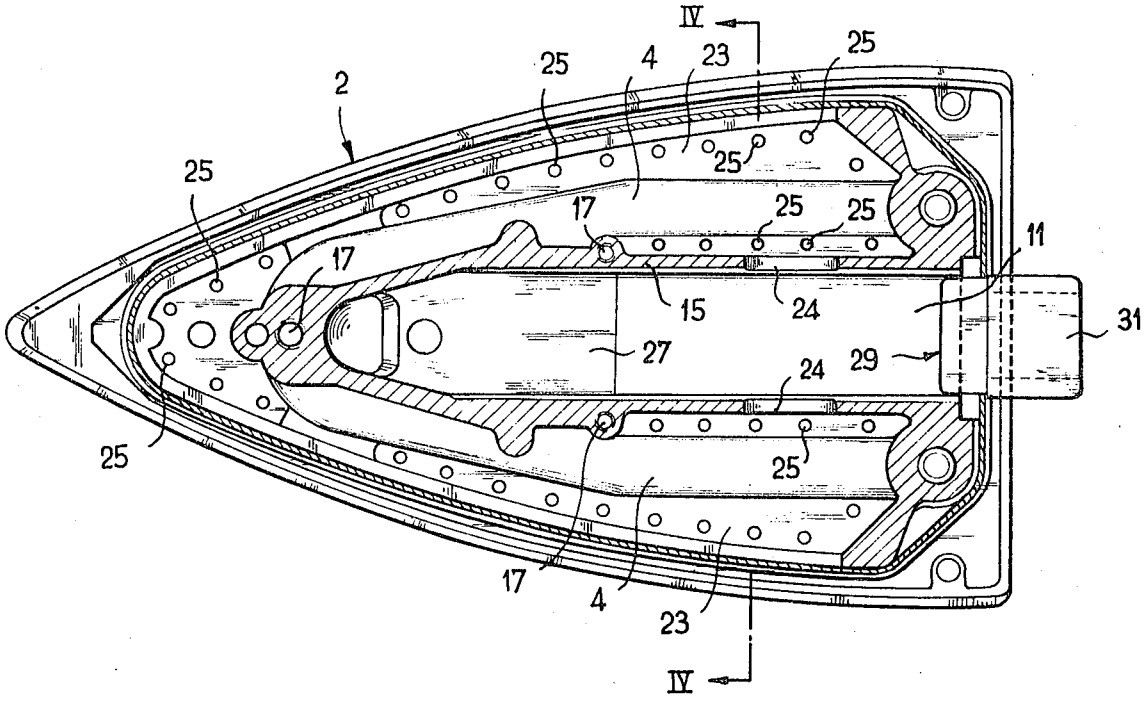
FIG. 3 is a horizontal sectional view of the sole-plate and of the cover, this view being taken along line III—III of FIGS. 1 and 4.

The vaporization chamber 11 extends over the entire length of the U formed by the heating resistor 3 which is housed within the embossment 4 (as shown in FIG. 3) and takes up substantially the entire space located between the arms of the resistor. This arrangement is made possible by the fact that the thermostat 10 is placed at the front end of the iron. The chamber 11 is delimited by a partition-wall 15 along its entire periphery with the exception of the rear portion of the chamber, namely the portion located on the right-hand side of FIG. 3. In the example herein described, said partition-wall 15 forms a single piece with the sole-plate 2 and follows the embossment 4 on the inside of the U.

A cover 16 which is generally flat and parallel to the sole-plate 2 completes the structure of the chamber 11 and is applied against the crest of the partition-wall 15 with interposition of sealing means of known type (not shown) such as a seal of silastene. However, these sealing means are not strictly essential. The cover 16 is fixed on the sole-plate by means of screws 17.

The cover 16 extends substantially over the entire width of the sole-plate 2 and has a skirt 18 which is supported within a groove 19 of the sole-plate 2 by a flange 21 with interposition of a seal 22 which can be a layer of silastene or a rubber seal. A steam distribution chamber 23 is thus delimited by the cover 16 between the skirt 18 of this latter and the partition-wall 15. Said distribution chamber takes up substantially the entire surface of the sole-plate 2 which is not occupied by the vaporization chamber 11.

The two chambers 11 and 23 communicate with each other by means of recesses 24 located in the rear third of the steam iron. The distribution chamber 23 communicates with the exterior by means of holes 25 which are drilled in the sole-plate.

The cover 16 has a raised portion 26 pierced by an opening through which the injection device 8 is permitted to pass in leak-tight manner. Directly beneath said injection device, the sole-plate 2 comprises a boss 27 which joins together the two arms of the U formed by the embossment 4 which contains the heating resistor 3. Said boss 27 slopes downwards towards the rear end of the iron and is provided with a milled cavity 28 directly beneath the injection device.

Figure 4:
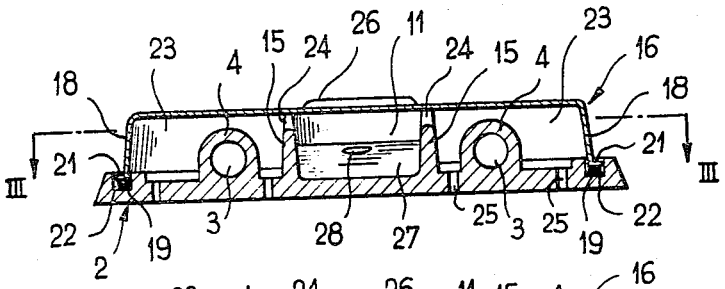
FIG. 4 is a transverse sectional view of the sole-plate and of the cover, this view being taken along line IV—IV of FIG. 3.

From the boss 27 to the rear end of the iron, the vaporization chamber 11 has a substantially constant cross-section in planes at right angles to the normal direction of forward displacement of the iron such as the plane of FIG. 4.

At the rear end of the iron, the skirt 18 of the cover 16 is cut-out in such a manner as to provide the vaporization chamber 11 with an opening having substantially the same dimensions as its constant cross-section mentioned above. This opening is sealed off by means of a detachable plug 29 of plastic material provided with a pull-out handle 31.

Figure 5:
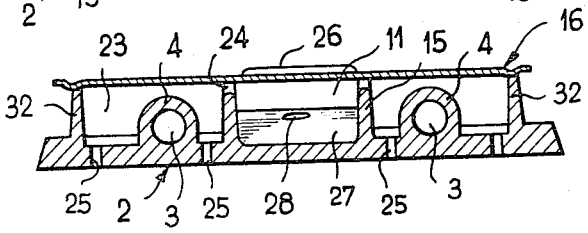
FIG. 5 is a view which is similar to FIG. 4 and shows another form of construction.

In an alternative embodiment of the invention, the cover 16 is not provided with a skirt (as shown in FIG. 5) and the outer boundary of the steam distribution chamber is constituted by a second partition-wall 32 which forms a single piece with the sole-plate 20 and is similar to the partition-wall 15, the cover 16 being thus intended to cooperate with the partition-walls 15 and 32 so as to define the two chambers 11 and 23. The partition-wall 32 is provided at the rear end with an interruption at the location of the plug 29.

Referring now to FIGS. 6 to 13, different possible alternative designs of the plug 29 will now be described.

Figure 6:
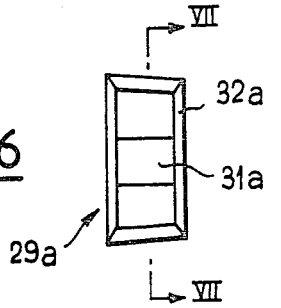
FIGS. 6 to 13 are front views and sectional views respectively, showing different forms of construction of the detachable plug of the vaporization chamber.
Figure 7:
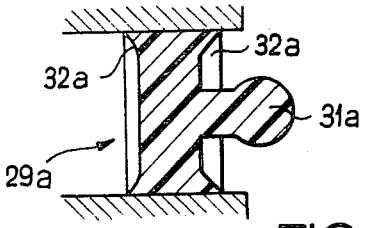
Figure 8:
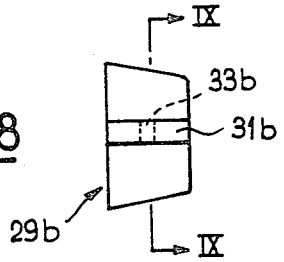
Figure 9:
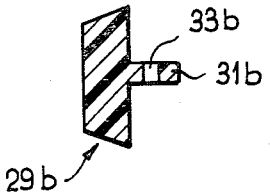
Figure 10:
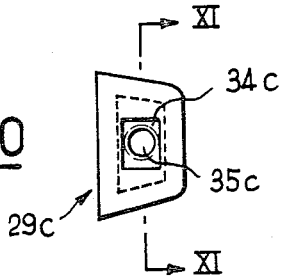

The plug 29*a* shown in FIGS. 6 and 7 is of silicone rubber and has lips 32*a* in order to ensure that the plug provides a tight seal.

The plug 29*b* (shown in FIGS. 8 and 9) has a frusto-pyramidal profile (FIG. 9) and can thus be more readily fitted in position. This plug is also of silicone rubber and its pull-out handle 31*b* is provided with a hole 33*b* which permits the use of a tool for facilitating removal of the plug.

Figure 11:
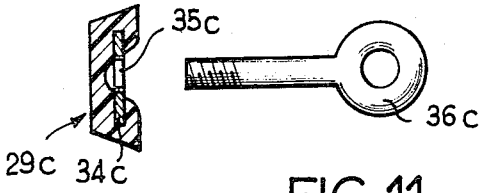
Figure 12:
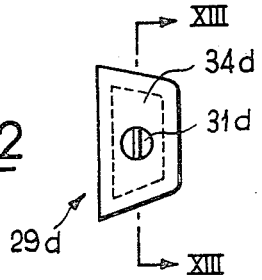
Figure 13:
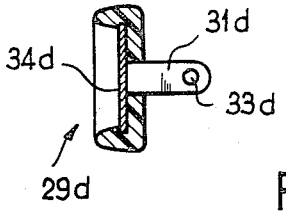

The plug 29*c* (shown in FIGS. 10 and 11) also has a frusto-pyramidal profile (FIG. 11). This plug has a metallic reinforcement member 34*c* which is embedded in the mass of rubber and is provided with an internally threaded bore 35*c* so as to permit adaptation of a threaded operating rod 36*c* for fitting or removing the plug.

The plug 29*d* (shown in FIGS. 12 and 13) also has a metallic reinforcement member 34*d* which is rigidly fixed to a pull-out handle 31*d* in which is pierced a hole 33*d* for the purpose of engaging a tool.

The operation of the steam iron described in the foregoing will now be explained.

After having filled the reservoir 6 and left the iron to heat-up for a sufficient period of time to attain a temperature which ensures vaporization, the injection device 8 is opened by means of the operating lever 9. The water then flows downwards drop by drop and falls onto the milled cavity 28 of the boss 27, then immediately begins to vaporize. But the fraction which is not immediately vaporized flows down the slope of the boss 27 to the rear portion of the vaporization chamber 11 and the vaporization process continues along the entire flow path and therefore on all the walls of the chamber. The flow of water is slightly slowed-down by the milled cavity 28 so that an appreciable fraction of the water vaporizes in this cavity which is the hottest point of the iron. Indeed, by virtue of the fact that the boss 27 establishes a thermal bridge between the two arms of the heating resistor 3, the heat is transferred preferentially to the region of the milled cavity 28. Furthermore, the boss 27 performs a heat storage function and consequently remains at a substantially constant temperature in spite of the intermittent actions produced by the thermostat 10 on the electric heating current.

The steam which is generated escapes through the recesses 24 towards the distribution chamber 23 which performs the function of a steam header. The discharge holes 25 are therefore all supplied at the same pressure and deliver steam at the same rates of flow.

By reason of the fact that the partition-wall 15 follows the embossment 4 on the inside of the U, said embossment which contains the heating resistor 3 is located within the distribution chamber 23 and continues to heat the steam which is present therein or at least serves to prevent cooling of the steam.

As a result of the large dimensions of the vaporization chamber 11, the scale deposit is distributed over a large surface and is consequently of very small thickness. Furthermore, these large dimensions permit of complete vaporization within said chamber 11, with the result that no deposition of scale takes place within the distribution chamber 23. This complete vaporization is obtained by virtue of the fact that the point of injection of water at which most of the vaporization process takes place is located near the front end of the iron whereas the discharge recesses 24 are located near the rear end. The long flow path which the steam is made to follow has the effect of permitting vaporization of residual water droplets.

Should it be desired to carry out a scale removal operation at long intervals of time in the event of intensive use of the iron, it is necessary only to remove the plug 29 and to scrape the walls of the vaporization chamber with any suitable tool such as a screwdriver. By reason of the great ease of access to the interior of the chamber and the resulting possibilities of rinsing, it is also possible to employ a de-scaling product.

However, by reason of the special arrangement of the vaporization chamber, the scale deposit is not usually of sufficient thickness to warrant the conclusion that the presence of the de-scaling orifice is to be considered as an essential improvement.

There will, in fact, be described below another embodiment of the invention in which the steam iron is not provided with a de-scaling orifice.

Reference being made to FIGS. 14 to 16, the vaporization chamber 111 is delimited by a partition-wall 115 and by a cover 116 which is similar to the cover 16 shown in FIG. 4.

The vaporization chamber 111 communicates with the distribution chamber 123 through recesses 124 which extend to the rear end of the partition-wall 115. The recesses 124 are oblong, the longest dimension of said recesses being parallel to the plane of the sole-plate 102 and their shortest dimension being perpendicular to said plane. Said recesses are located in the immediate vicinity of the cover 116 in the rear third of the chamber.

Furthermore, the partition-wall 115 stops short of the rear portion of the skirt 118 of the cover 116 so as to form a passage 141 between the end of the partition-wall and said rear portion of skirt.

Finally, the cylindrical ends of the embossment 104 through which the ends of the heating resistor 103 9are brought-out are insulated and leave a passage 142 between these latter and the partition-wall 115.

The characteristic features of this embodiment are not described but are the same as those already noted earlier with reference to FIGS. 1 to 4.

The operation of the iron is also substantially the same as in the previous embodiment but has a further advantage in that the steam outlet section represented by the recesses 124 and the passages 141 is generally located even farther towards the rear of the iron. This has the favorable effect of lengthening the steam flow path to an even greater extent.

Moreover, any droplets which may not have vaporized have a tendency to move down to the vicinity of the bottom of the chamber 111 under the action of gravity. By reason of the raised position of the recesses 124, these droplets consequently have a lesser tendency to be entrained with the steam.

Finally, it may happen that the chamber 111 is partly flooded with water as a result of a faulty operation consisting, for example, in opening the injection pintle before the temperature of the iron has reached a sufficiently high value to initiate vaporization. As a general rule, this water has the effect of slowing down subsequent vaporization and produces steam charged with droplets. By means of the passage 141 provided in this embodiment, however, the water is permitted to escape immediately from the chamber 111 and can be instantaneously discharged through the chamber 123 and the steam holes 125, thus emptying the vaporization chamber.

Under normal conditions of service, the injected water is completely vaporized before reaching the passage 141 and this does not present any difficulty or drawback.

The invention therefore makes it possible to produce a steam iron in which scale formation is very slight, very slow and practically without any disadvantage. However, if it is desired to remove scale from the iron, this operation can be carried out easily and efficiently in a very short time.

It is even an easy matter to remove the cover 16 by unscrewing the screws 17 in order to gain complete access to both chambers if necessary, provided only that the sealing means are replaced between the cover and the sole-plate at the time of re-assembly.

Furthermore, dry steam is discharged from the iron and distributed through all the holes of the sole-plate in a uniform manner.

As can readily be understood, the invention is not limited to the examples hereinabove described and many alternative forms of construction could accordingly be devised without thereby departing either from the scope or the spirit of the invention.

I claim:

1. In an electric steam iron comprising a water reservoir fitted with a device for injecting water into a vaporization chamber formed in a sole-plate which is heated by a U-shaped electric resistor, the arms of the U being disposed along the two sides of the iron which have the greatest length and the point of injection being located in the vicinity of the base of the U and said vaporization chamber being adapted to occupy at least part of the space located between the resistor arms and to communicate with a distribution chamber through a partition-wall, said distribution chamber being in communication with the exterior through discharge holes having outlets on the underface of the sole-plate; the improvement wherein the vaporization chamber occupies substantially the entire space formed between the arms of the resistor and extends to the rear edge of the sole-plate, a communication between the two chambers being established by means of recesses formed in the partition-wall and located in the rear portion of the iron, the vaporization chamber having a substantially constant cross-section in planes at right angles to the normal direction of forward displacement of the iron and terminates at the rear end of the iron in a pluggable orifice which has substantially the same cross-sectional area.

2. A steam iron according to claim 1, wherein the recesses are located in the rear third of the iron.

3. A steam iron according to claim 2, wherein the recesses extend to the rear end of the partition-wall.

4. A steam iron according to claim 1, wherein the walls of the chambers opposite to the sole-plate are provided with a cover which is applied against the crest of the partition-wall.

5. A steam iron according to claim 4, wherein the recesses are oblong and have a dimension parallel to the sole-plate which is longer than the dimension at right angles to the sole-plate, said recesses being located in the vicinity of the cover which cooperates with the partition-wall.

6. A steam iron according to claim 4, wherein the distribution chamber is limited externally by a partition-wall against which the cover is applied.

7. A steam iron according to claim 4, wherein the distribution chamber is limited externally by a peripheral skirt of the cover.

8. A steam iron according to claim 7, wherein a passage is formed between the rear end of the partition-wall and the rear portion of skirt of the cover.

9. A steam iron according to claim 1, wherein the rear orifice of the vaporization chamber is closed by means of a plug or plastic material which provides a tight seal by virtue of the elasticity of the material.

10. A steam iron according to claim 1, wherein the vaporization chamber comprises a boss which serves to join together the two arms of the heating resistor and is located directly beneath the water injection device.

* * * * *